US005946025A

United States Patent [19]

Allen

[11] Patent Number: 5,946,025

[45] Date of Patent: Aug. 31, 1999

[54] THERMAL DRUM PROCESSOR ASSEMBLY WITH ROLLER MOUNTING ASSEMBLY FOR A LASER IMAGING DEVICE

[75] Inventor: John J. Allen, Mendota Heights, Minn.

[73] Assignee: Imation Corp., St. Paul, Minn.

[21] Appl. No.: 08/940,091

[22] Filed: Sep. 29, 1997

[51] Int. Cl.[6] ..... G03G 15/20

[52] U.S. Cl. ..... 347/262; 347/221; 347/222; 347/264; 399/328; 399/330; 399/331

[58] Field of Search ..... 347/204, 221, 347/222, 242, 262, 263, 264; 399/328, 330, 331, 332; 299/216; 248/674; 432/60

[56] References Cited

U.S. PATENT DOCUMENTS

| | | | |
|---|---|---|---|
| 3,012,141 | 12/1961 | Thomiszer | 219/216 |
| 3,242,316 | 3/1966 | Craskens | 219/471 |
| 3,243,579 | 3/1966 | Sussin | 219/469 |
| 3,439,905 | 4/1969 | Noble | 335/299 |
| 3,629,549 | 12/1971 | Svensen | 219/216 |
| 3,709,472 | 1/1973 | Kreitz et al. | 432/60 |
| 3,716,018 | 2/1973 | Ohta et al. | 118/101 |
| 3,739,143 | 6/1973 | Amundson et al. | 219/216 |
| 3,781,902 | 12/1973 | Shim et al. | 346/24 |
| 3,797,127 | 3/1974 | Yamada et al. | 34/123 |
| 3,873,810 | 3/1975 | Larson | 219/535 |
| 3,934,113 | 1/1976 | Bar-on | 219/216 |
| 4,147,501 | 4/1979 | Goshima et al. | 432/60 |
| 4,172,975 | 10/1979 | Noda | 219/216 |
| 4,304,985 | 12/1981 | Miller | 219/216 |
| 4,315,682 | 2/1982 | Parzanici | 399/322 |
| 4,335,951 | 6/1982 | Scribner | 399/339 |
| 4,360,566 | 11/1982 | Shimuzu et al. | 428/404 |
| 4,387,980 | 6/1983 | Ueno et al. | 399/174 |
| 4,518,845 | 5/1985 | Svendsen | 219/216 |
| 4,819,032 | 4/1989 | Nagumo | 355/405 |
| 4,825,041 | 4/1989 | Nagumo et al. | 219/244 |
| 4,869,455 | 9/1989 | Weeks | 248/674 |
| 4,883,941 | 11/1989 | Martin et al. | 219/216 |
| 5,091,281 | 2/1992 | Nakamura et al. | 430/203 |
| 5,132,726 | 7/1992 | Yokota et al. | 355/100 |
| 5,151,576 | 9/1992 | Zaoralek | 219/469 |
| 5,241,159 | 8/1993 | Chatterice et al. | 219/470 |
| 5,352,863 | 10/1994 | Svendsen | 219/388 |

FOREIGN PATENT DOCUMENTS

| | | |
|---|---|---|
| 0 262 833 A2 | 4/1988 | European Pat. Off. . |
| 0 500 047 A3 | 8/1992 | European Pat. Off. . |
| 0 546 190 A1 | 6/1993 | European Pat. Off. . |
| 765 175 | 6/1934 | France . |
| 1 338 102 | 8/1963 | France . |
| 59-083182 | 5/1984 | Japan . |

*Primary Examiner*—N. Le
*Assistant Examiner*—Hau C. Pham
*Attorney, Agent, or Firm*—Dicke, Billig & Czaja, P.A.

[57] ABSTRACT

A film thermal processor assembly for use in an imaging system. The assembly includes a retention member for receiving a plurality of thermal processor rollers and their shaft mounted sleeve bearings which are adapted for snap insertion into snap fingers of the injection molded non-metallic retention member. The rotation member holds bias springs for radially loading the rollers. A direct contact thermal sensor having a large sensing area, which conforms to the shape of the drum, directly measures the surface temperature of the processing drum.

12 Claims, 9 Drawing Sheets

THERMAL DRUM PROCESSOR ASSEMBLY WITH ROLLER MOUNTING ASSEMBLY FOR A LASER IMAGING DEVICE

FIELD OF THE INVENTION

The present invention relates generally to optical scanner systems and laser imaging systems incorporating such scanners. In particular, the present invention relates to a thermal drum processor assembly for use within a laser imaging system, including a roller mounting assembly which allows easy installation and removal of processor rollers.

BACKGROUND OF THE INVENTION

Laser imaging systems are commonly used to produce photographic images from digital image data generated by magnetic resonance (MR), computed tomography (CT), or other types of scanners. Systems of this type typically include a continuous tone laser imager for exposing the image on photothermographic film, a thermal film processor for developing the film through the application of heat, and an image management subsystem for coordinating the operation of the laser imager and the thermal film processor. The light sensitive photothermographic film can include a polymer or paper base coated with an emulsion of dry silver or other heat sensitive material.

One known type of thermal processor for use in developing the photographic film utilizes a thermal drum processor. Once the film has been subjected to photo stimulation by optical means such as laser light, it is fed into the thermal drum processor for development.

The thermal drum processor includes a rotating drum cylinder which is heated to develop the film. For example, the drum surface may be heated utilizing a heating element coupled to the internal surface of the drum, or alternatively, other methods may be used such as the rotating drum cylinder being located within an oven-like enclosure.

The film is engaged by the rotating drum and heated for a desired period or "dwell time" to allow for development of the images on the photothermographic film. Mechanisms may be employed for holding the film against the rotating drum surface, such as the use of a plurality of rollers positioned about the drum surface.

In known systems the installation of the plurality of necessary rollers in the drum has proven to be a complex operation requiring a number of exacting mechanical operations and requiring a multiplicity of mechanical parts that are required to be aligned and adjusted as part of the installation process. Presently, the rollers in the film thermal processing drum are mounted to a die cast metal housing where the rollers are inserted into slots in the housing. Each roller is individually secured to the housing using metal fasteners which are required to be screwed down on both the inside and outside of the housing.

In light of the known drawbacks of present laser image thermal processing devices, it is desirable to have a roller mounting assembly for use in a thermal drum processor system which allows for quicker installation of rollers about the drum and also minimizes the complexity of the assembly by reducing the number of parts necessary for its installation, maintenance and use. Further, it is desirable to have a roller mounting assembly which allows for easy access and removal of the rollers for maintenance and cleaning.

Further, the temperature of the processing drum is a critical element in the carrying out of the thermal processing process. In particular, it is the temperature of the surface of the drum that is a critical parameter to be measured and controlled for uniform and controlled development of images on the film. In existing systems, one known place for the measurement of the temperature of the drum is accomplished by mounting a resistance thermal device (RTD) element to the internal surface of the drum. An internally mounted temperature sensing system has several disadvantages: it does not give a true, more direct reading of the drum surface temperature; it requires more costly assembly; and measurement of the RTD state must pass through a slip-ring connection or requires that the control and measurement hardware be positioned on the rotating drum. It is desirable to provide a mechanism for measuring the surface temperature of the drum directly and accurately for improved control of the thermal processing operation, while reducing overall complexity and cost of the temperature sensing system.

SUMMARY OF THE INVENTION

The present invention provides a thermal drum processor for use in a laser imaging system having a rotatable drum including a molded roller mounting assembly which allows easy installation and removal of processor rollers without the use of tools.

In one exemplary embodiment, the thermal drum processor in accordance with the present invention has a rotatable drum, including an exterior drum surface and an axis of rotation extending longitudinally therethrough. The improvement comprises a roller mounting assembly for removably mounting a plurality of longitudinally extending rollers about the exterior drum surface. The rollers are mounted generally parallel to the axis of rotation of the drum, the roller mounting assembly includes a roller retaining member, wherein the roller retaining member includes a plurality of roller attachment mechanisms spaced in a semicircular pattern which is defined as a plurality of roller mounting locations, and wherein the rollers removably snap fit into each roller mounting location. The roller retaining member is preferably made of a high temperature molded polymeric material.

The improvement may further comprise the roller retaining member including a plurality of spring cavities, wherein each spring cavity is located adjacent one of the roller mounting locations. A spring mechanism is located in each spring cavity for applying a radial bias force to the shaft of a roller mounted in the roller mounting location associated therewith to urge the roller into a film engaging nip between the roller and the exterior drum surface.

The roller attachment mechanism includes a plurality of snap fingers extending from the roller retainer member, wherein a pair of adjacent snap fingers define a roller mounting location. Each roller comprises a longitudinally extending shaft having a sleeve bearing mounted thereon for insertion into a roller mounting location, and thereby allowing rotation of each roller relative to the roller retaining member. In one preferred embodiment, the sleeve bearing is made of a polymeric material.

In another embodiment, the present invention includes a film thermal drum processor having a rotatable drum, including a drum surface and an axis of rotation extending therethrough and a plurality of pressure rollers whose axis are aligned parallel to the axis of rotation of the drum and are circumferentially arranged to align the surfaces of the roller with the outer surface of the drum. A pair of roller retention members are provided for rotatably receiving both ends of the rollers. Each of the roller retention members include a frame mountable in the processor adjacent the drum. A plurality of roller attachment means are disposed along an interface of the frame in a semi-circular array of roller mounting locations. A plurality of spring cavities are positioned in said frame, each of which is positioned adjacent a roller mounting location. A plurality of springs are positioned in each of said spring cavities for applying a radial bias force to the shaft of a roller mounted in the roller mounting location associated therewith, and urging the roller into a film engaging nip between its shaft and the outer surface of said drum.

The attachment means for each roller may include a pair of snap fingers adapted for receiving the shaft of a roller snapped into engagement with the fingers thereof in a roller mounting location. The shaft of each roller may include a plastic sleeve bearing member mounted thereon prior to insertion into the snap fingers of the attachment means. In particular, the plastic sleeve bearing members are engaged by the fingers. In one preferred embodiment, the retention member is molded as a unitary construction from a polymeric material. Further, the retention member may be made using a S straight pull mold for reduced costs. The retainer directly engages the drum instead of aligning through the drum housing.

In another embodiment, the thermal drum processor in accordance with the present invention includes a rotatable drum having a drum surface and an axis of rotation longitudinally extending therethrough, and a temperature sensor for directly sensing the temperature of the outer surface of the drum. The temperature sensor includes a mounting member and a flexible sensor sheet attached at one end to the mounting member and having a temperature sensing area thereon. A leaf spring mechanism coupled at one end thereof to the mounting mechanism and in contact at the other end thereof to a pressure application region between the temperature sensing area and a second end of the flexible sensor sheet for urging the sensing area of the sensor sheet into cylindrically conforming contact with the surface of the drum. The leaf spring mechanism may be formed integral the mounting mechanism. The flexible sensor sheet may include a serpentine pattern of a single RTD wire embedded within or sandwiched between sheets of flexible electrically insulating material. In one application, the insulating material is made of polyimide or polytetrafluoroethylene. In one embodiment, the temperature sensing area does not extend into the pressure application region thereof.

BRIEF DESCRIPTION OF THE DRAWINGS

The accompanying drawings are included to provide a further understanding of the present invention and are incorporated and constitute a part of this specification. The drawings illustrate the exemplary embodiments of the present invention and together with the description, serve to explain the principles of the invention. Other objects of the present invention, and many of the intended advantages of the present invention, will be readily appreciated as the same becomes better understood by reference to the following detailed description, which, when considered in connection with the accompanying drawings, in which like reference numerals designate like or similar parts throughout the drawing figures and wherein.

DETAILED DESCRIPTION OF THE INVENTION

Figure 1:
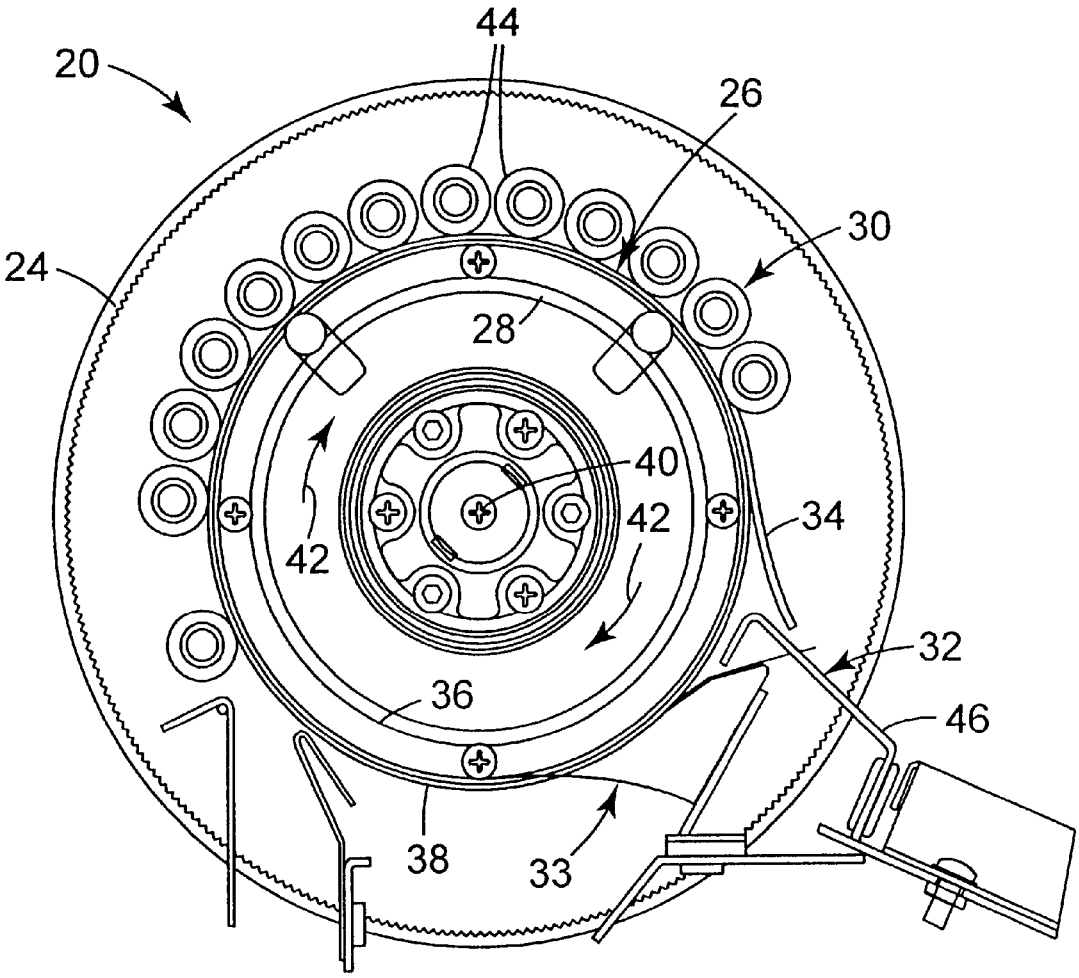
FIG. 1 is a partial end view of a film thermal processor and pressure rollers in accordance with the present invention.

In FIG. 1, a thermal drum processor 20 of the type wherein the roller mounting assembly and the thermal sensor for sensing the temperature of the drum surface in accordance with the present invention may be preferably used is generally shown. Processor 20 includes a frame 24, a cylindrical drum 26, a heating mechanism 28, a film holding mechanism or assembly 30, a film guide assembly 32, and a thermal sensor 33. Operation of a thermal drum processor system used within a laser imaging system which can be similar to the operation of the thermal processor described herein is disclosed in U.S. patent application Ser. No. 08/239,709, filed on May 9, 1994, entitled Apparatus, system, and Method for Processing Photothermographic Elements, the entire contents of which are incorporated herein by reference. Drum surface temperature sensing device 33 is shown positioned against the drum surface. Additionally, film 34 is shown being fed into thermal drum processor 20.

Cylindrical drum 26 is rotatably coupled to frame 24. Cylindrical drum 26 is rotated using mechanisms as known in the art (e.g., use of a motor). Cylindrical drum 26 includes an interior drum surface 36 and an exterior drum surface 38. In one preferred embodiment, cylindrical drum 26 is constructed of aluminum. Exterior drum surface 38 is coated with a material compatible with film 34, for example, silicone rubber. Heating mechanism 28 includes a heating element which is positioned about the interior drum surface 36 for uniform heating of cylindrical drum 26. In one preferred application, heating mechanism 28 uniformly heats cylindrical drum 26 to a film development temperature of 252° F. It is recognized that the desired film development temperature may vary, which may depend on the processing characteristics of the film and the desired processing rate.

Cylindrical drum 26 includes a longitudinal axis 40 (shown in end view) extending therethrough. In operation, a rotating mechanism, for example, a motor, rotates the cylindrical drum about the longitudinal axis 40 during operation of the thermal drum processor 20, indicated by directional arrow 42. As film 34 is fed into thermal drum processor 20, it is positioned or held against external drum surface 38. In the embodiment shown, film holding assembly 30 includes a plurality of pressure rollers 44. As film 34 enters thermal drum processor 20, cylindrical drum 26 is rotating and film 34 is grabbed by pressure rollers 44 and held firmly against exterior drum surface 38.

After development of film 34, guide assembly 32 aids in directing film 34 along a film transport path into a cooling section for the cooling of the film 34. Guide assembly 32 may include guide or mounting bar 46. Mounting bar 46 is spaced apart from exterior drum surface 38, and extends longitudinally along exterior drum surface 38 in a direction which is generally perpendicular to the direction of rotation 42 of the cylindrical drum. In one embodiment, mounting bar 46 is constructed of aluminum, and is spaced 35–40/1000 of an inch away from exterior drum surface 38. Mounting bar 46 aids in directing film 34 away from the exterior drum surface 36 of heated cylindrical drum 26 and toward, for example, a cooling section. One known thermal drum processor having a guide assembly including a guide bar (similar to mounting bar 46) is disclosed in U.S. patent application Ser. No. 08/239,709, filed on May 9, 1994, previously incorporated herein.

The thermally processed film, for example film 34, is a photothermographic film. The photothermographic film is light sensitive, such that an image may be exposed on the photographic film using an optical process, for example, a laser imaging process. The photothermographic film is developed using a process wherein heat is applied to the film. Known sensitive photothermographic films typically include a polymer or paper base coated with an emulsion of dry silver or other heat sensitive material. In one exemplary embodiment, the film is DryView™ laser imaging film (DVB or DVC), manufactured by Imation Corp. of Oakdale, Minn.

Figure 2:
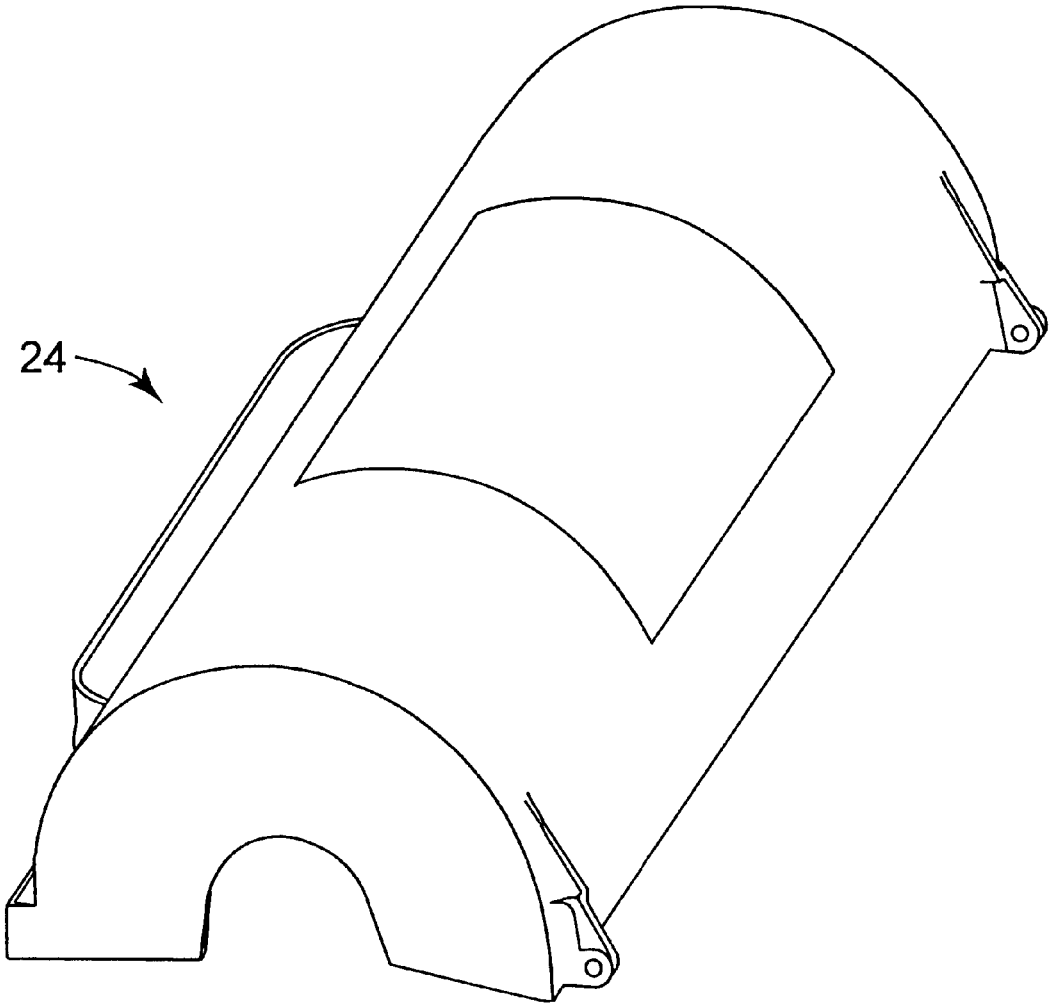
FIG. 2 is a partial perspective view of a thermal processor assembly in accordance with the present invention illustrating the assembly housing removed from the thermal processor drum.
Figure 3:
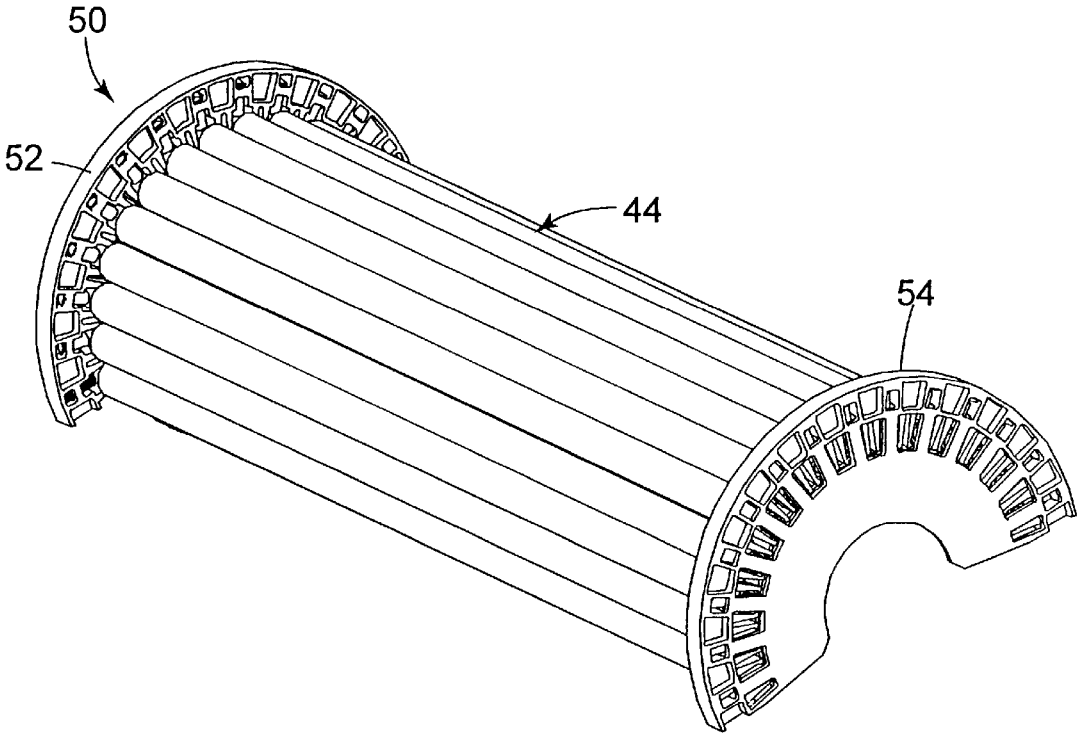
FIG. 3 is a perspective view illustrating an exemplary embodiment of a roller mounting assembly for use with a thermal drum processor in accordance with the present invention.

Referring to FIG. 2, a perspective view of the thermal drum processor frame or housing 24 is shown removed from the thermal drum processor 20 (including the thermal processor drum). The frame or housing 24 is preferably constructed of a rigid polymeric material, such as polycarbonate, and includes film holding assembly 30 having a roller mounting assembly 50 in accordance with the present invention contained therein. Referring to FIG. 3, the roller mounting assembly 50 is shown removed from the housing 24. The roller mounting assembly 50 includes a plurality of the longitudinally extending rollers 44 which are rotatably coupled at each end to a pair of retaining members, indicated as first retaining member 52 and second retaining member 54. The novel retaining members 52, 54, in accordance with the present invention, allow for easy insertion and/or removal of rollers 44 for replacing, maintenance or cleaning of the rollers and the thermal drum processor 20.

Figure 4:
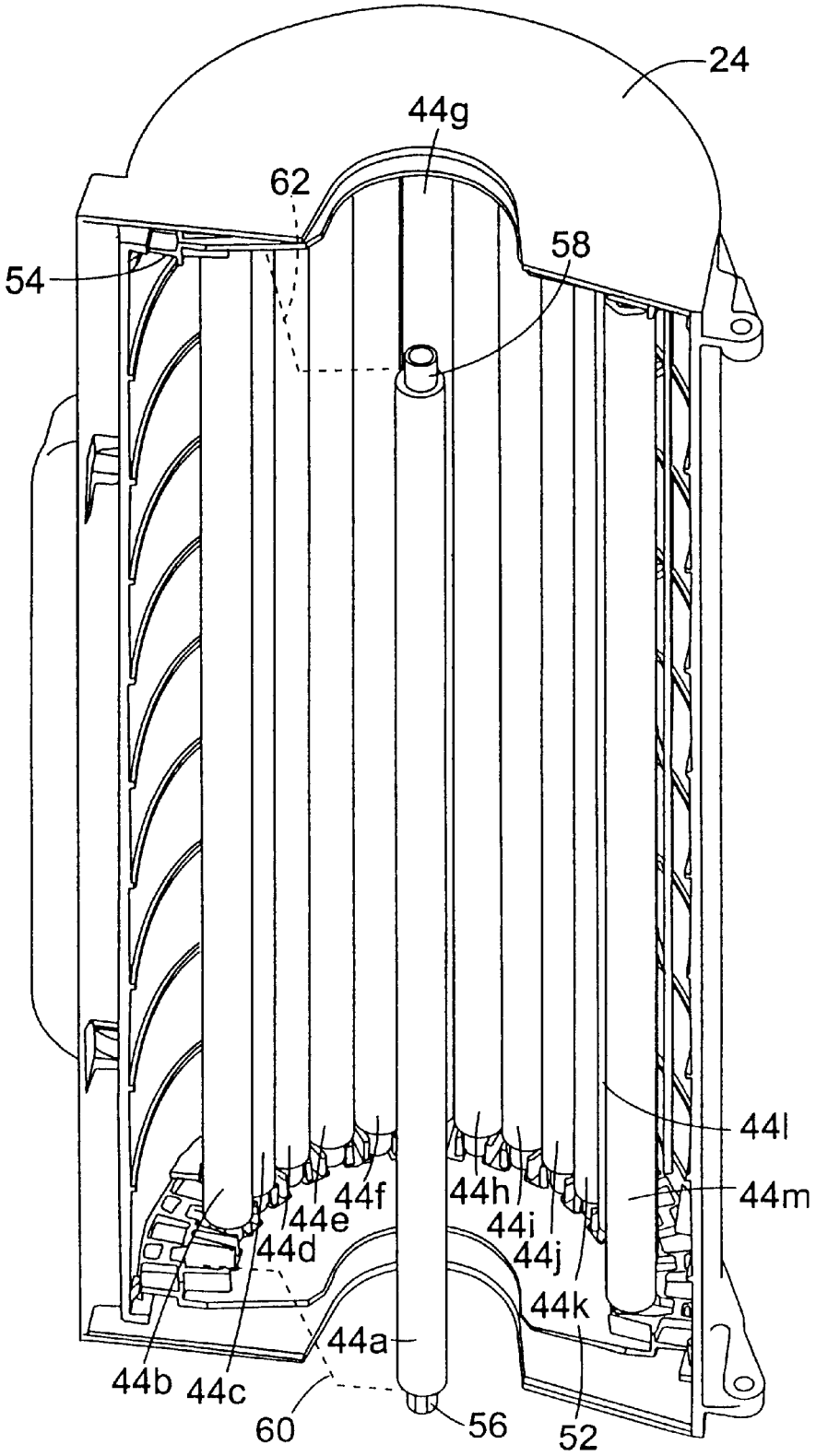
FIG. 4 is a perspective elevation view of an opened processor housing having a roller mounting assembly in accordance with the present invention disposed therein.

Referring to FIG. 4, roller assembly 50 is shown positioned within housing 24. The remaining portion of the thermal drum processor 20 is not shown to permit the roller assembly 50, including pressure rollers 44 (indicated as 44*a*, 44*b*, 44*c*, 44*d*, 44*e*, 44*f*, 44*g*, 44*h*, 44*i*, 44*j*, 44*k*, 44*l*, and 44*m*) and first retaining member 52 and second retaining member 54, to be seen. As shown, rollers 44 may be easily rotatably coupled between first retaining member 52 and second retaining member 54. In particular, roller 44 includes a first end 56 and a second end 58. First roller end 56 removably couples to first retaining member 52, indicated by dashed line 60, and second roller end 58 removably couples to second retaining member 54, indicated by dashed line 62.

Figure 5:
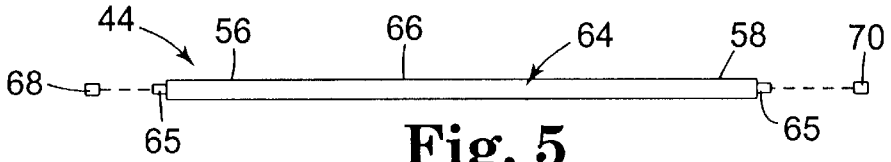
FIG. 5 is a plan view illustrating a roller assembly for use with a thermal drum processor in accordance with the present invention.

Referring also to FIG. 5, one exemplary embodiment of a thermal drum processor roller, for example pressure roller 44, is shown in expanded view. Each roller 44 includes a longitudinally extending shaft 64 having a reduced radius portion 65 at each end 56, 58 and body portion 66 over a central portion thereof. A plastic sleeve bearing is rotatably coupled at (and placed over) each end 65 of roller 44. As shown, first plastic sleeve bearing 68 is rotatably coupled to shaft 64 at end 56, and second plastic sleeve bearing 70 is rotatably coupled to shaft 64 at second end 58. Upon insertion of roller 44 into the roller assembly first retaining member 52 and second retaining member 54, the roller 44 shaft 64 are rotatable relative to first plastic sleeve bearing 68 and second plastic sleeve bearing 70. First plastic sleeve bearing 68 and second plastic sleeve bearing 70 remain fixed relative to first retaining member 52 and second retaining member 54, and frame or housing 24. In one particular embodiment, plastic sleeve bearing 68, 70 include a pair of flat surfaces on opposite sides, termed anti-rotation flats, such that when the sleeve bearing 68, 70 are snapped or coupled to retaining members 52, 54, the sleeve bearings 68, 70 do not rotate relative to the retaining members 52, 54.

Figure 6:
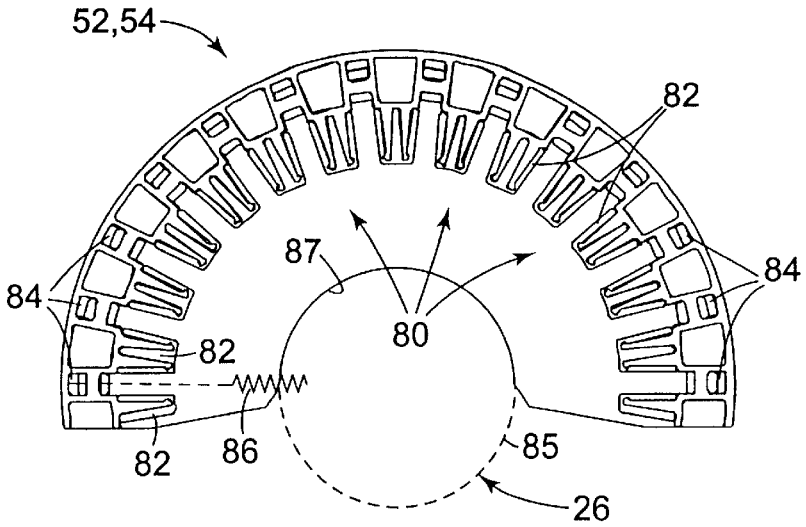
FIG. 6 is a plan view illustrating one exemplary embodiment of a roller retaining member for use with a roller mounting assembly in accordance with the present invention.

Referring to FIG. 6, a plan view of a molded retaining member, indicated as first retaining member 52 or second retaining member 54 is shown. Retaining members 52, 54 are formed from a high temperature moldable plastic or polymeric material which receives the sleeve bearings of an array or plurality of rollers 44 and positions rollers 44 in a semi-circular pattern, such that when the roller mounting assembly 50 is positioned within thermal drum processor 20, the rollers 44 are positioned about cylindrical drum 26. The longitudinally extending axis of the plurality of rollers 44 are aligned parallel to the axis of rotation 40 of the drum 26.

Further, retaining members 52, 54 include a semi-circular shaped drum coupling edge 87. The drum coupling edge 87 directly couples the retaining members 52, 54 to a hub end cap screwed onto each end of the drum 26. The hub end cap is indicated by the dashed line 85 (also shown in FIG. 9). The hub end cap is made of a bearing material, such as ULTEM, which provides a bearing surface between retaining members 52, 54 and the drum 26 hub 85. In conventional processor assemblies, roller retaining members are coupled to the drum through the thermal processor housing. As such, due to the number of parts between the retaining members and the drum, tolerance problems may exist. With the present invention, the retaining members 52, 54 are directly coupled to the drum hub 85, thereby reducing or eliminating such problems.

Each retaining member 52, 54 includes a plurality of mounting locations 80. A plurality of roller attachment mechanisms or snap fingers 82 are spaced radially about the retaining member 52, 54. A pair of adjacent snap fingers 82 defines a roller mounting location 80. As such, at each roller mounting location 80, adjacent pairs of snap fingers 82 are adapted for releasably engaging first roller end 56 or second roller end 58 at its bearing member 68 or 70. Additionally, each roller mounting location 80 includes a spring cavity 84 between the snap fingers 82. A compression spring 86 is inserted in each spring mounting cavity 84 and projects radially inward into the roller mounting location 80 between each of the pairs of snap fingers 82. As such, when a pressure roller is installed between first retaining member 52 and second retaining member 54, and for example, when a sleeve bearing, such as first plastic sleeve bearing 68 or second plastic sleeve bearing 70, is inserted within a roller mounting location 80, mounting spring 86 provides a radial bias force urging the roller 44 inward. In one exemplary embodiment, mounting springs 86 provide a spring-force of 2.2 Newtons. As such, the mounting springs 86 bias the rollers 44 against the drum surface.

Figure 7:
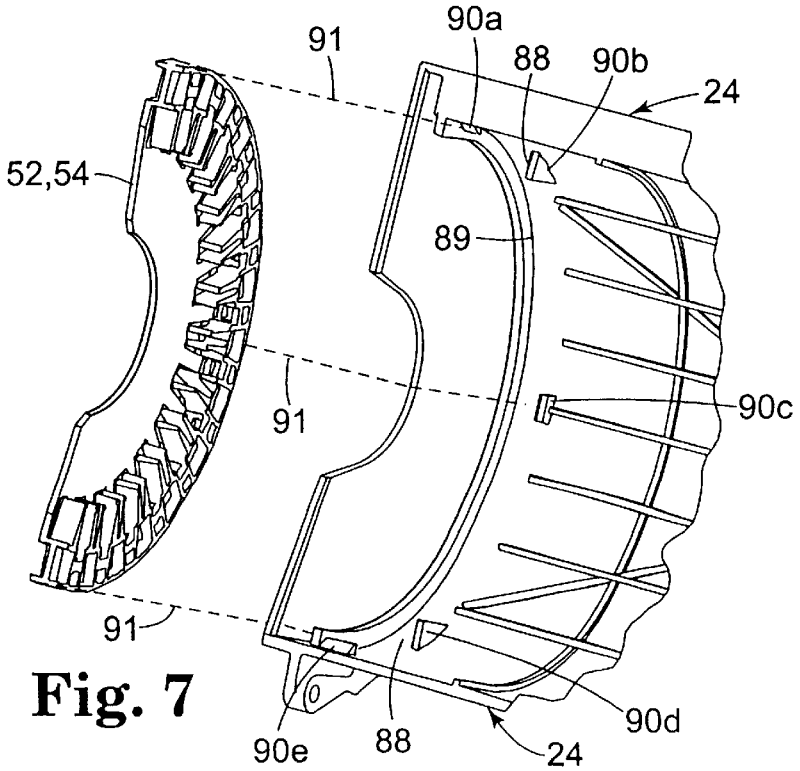
FIG. 7 is a partial perspective view illustrating the mounting of a roller retaining member within a thermal drum processor housing.

Referring to FIG. 7, a partial perspective view illustrating insertion of the roller assembly 50 into housing 24 is generally shown. In particular, housing 24 includes a semi-circular shaped channel 88 at each end. The channel 88 is defined by extension member 89 and channel guide members 90 (indicated as 90*a*, 90*b*, 90*c*, 90*d*, and 90*e*). The semi-circular channel 88 is sized and shaped for receipt of first retaining member 52 or second retaining member 54. As such, first retaining member 52 or second retaining member 54 are easily inserted and snapped into the channel 88, indicated by dashed lines 91.

As can be seen, there are some notable advantages derived from utilization of the molded roller retaining members over the previous metal retaining parts where individual fasteners were required to be inserted to retain each of the rollers in place. In the processor assembly in accordance with the present invention, the use of the retaining members 52, 54 provide an easily used cavity to capture biasing mounting springs 86 which are in turn retained in place once snap fingers 82 engage the shaft ends of rollers 44. In addition to the ease with which rollers 44 may be installed in retaining members 52, 54, they can equally readily be removed by snapping rollers 44 out to reduce the difficultly of servicing and replacing the rollers should that become necessary.

Each retaining member is preferably molded from a high temperature plastic resin, such as ULTEMO resin, and has a shape that can readily be produced using injection molding techniques that are well recognized in the art. The shape of the mechanical features of the retaining member allow a straight pull of the injection mold tool without cammed inserts. In one preferred embodiment, the pressure rollers 44 are manufactured from anodized aluminum with the shaft ends turned to a reduced radius to receive plastic sleeve bearings 68, 70 which are placed over their ends prior to installation of rollers 44 in the retaining members 52, 54. It is recognized that pressure rollers 44 may be made of other suitable metallic or nonmetallic materials (e.g., a polymeric material, steel, or a metallic shaft having an elastomeric coating).

Figure 8:
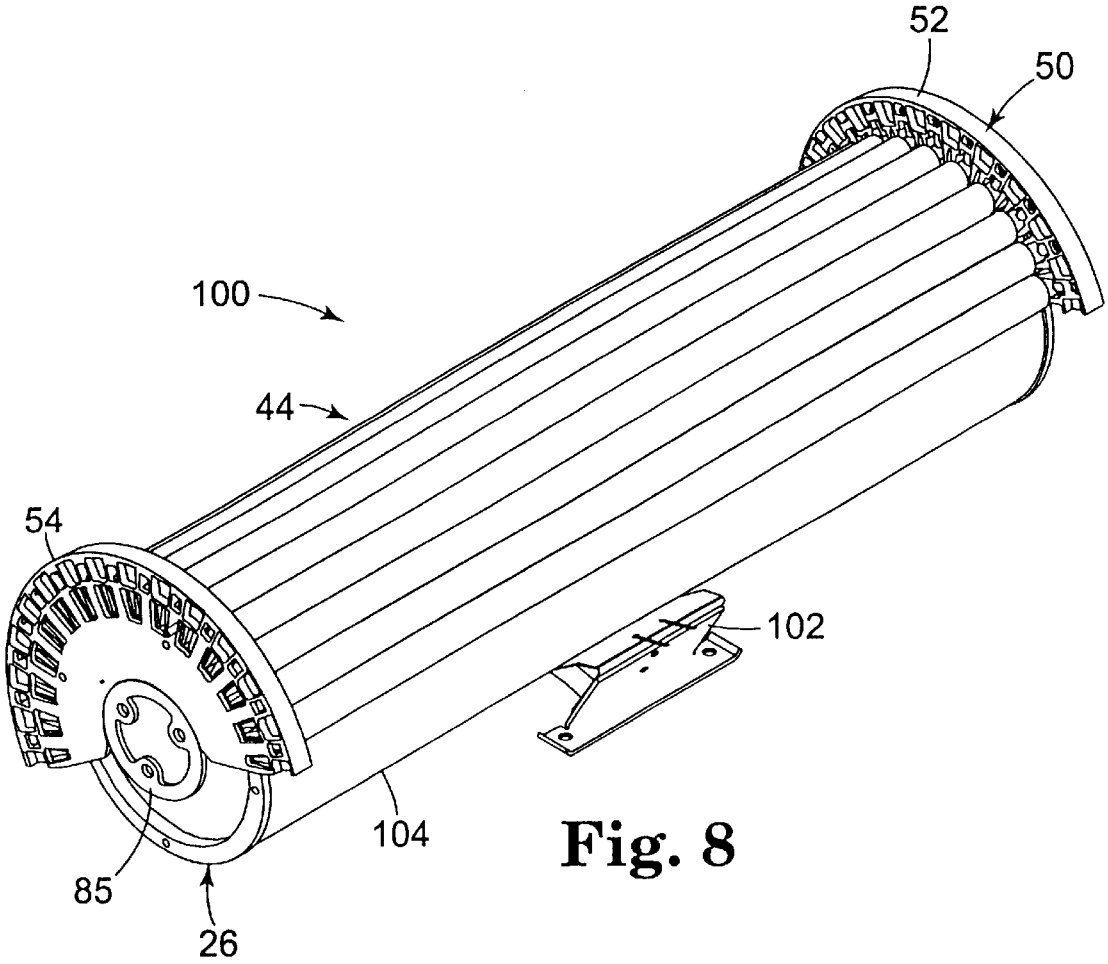
FIG. 8 is a partial perspective view illustrating a thermal drum processor in accordance with the present invention having the housing removed showing a thermal sensor for directly sensing drum surface temperature in accordance with the present invention.
Figure 9:
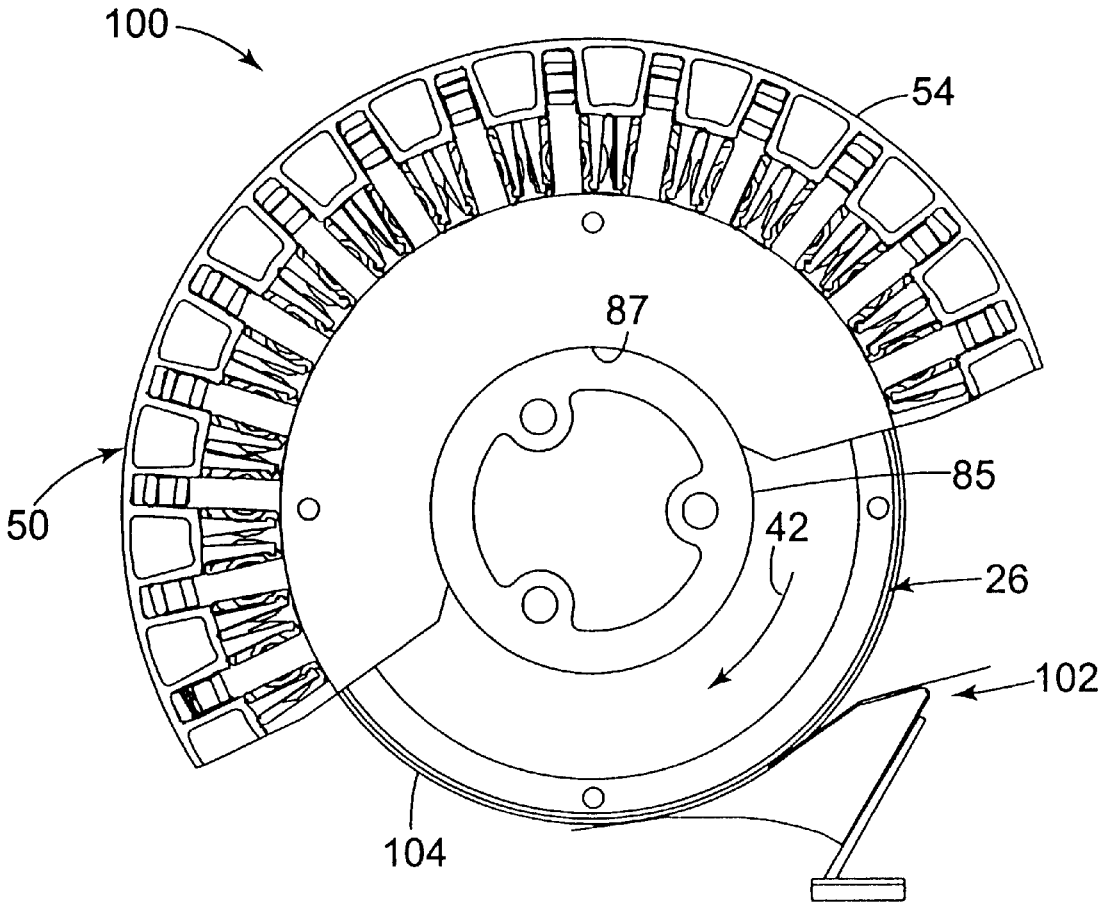
FIG. 9 is an end view illustrating the thermal drum processor having a thermal sensor shown in FIG. 8.

Referring to FIG. 8, another embodiment of the thermal processor in accordance with the present invention is generally shown at 100 (with the housing 24 removed). The thermal processor 100 can be similar to the thermal processor 20 previously described herein, and includes a thermal sensor 102 positioned about the exterior surface 104 of the cylindrical drum 26 for direct measurement of drum surface temperature. Referring to FIG. 9, an end view of the thermal drum processor 100 of FIG. 7 is generally shown. A shown, thermal sensor 102 is a flexible sensor which flexes to conform to the shape of the exterior surface of the cylindrical drum 26. The flexibility of thermal sensor 102 allows a true and direct temperature of the cylindrical drum surface 104 to be read.

Figure 10:
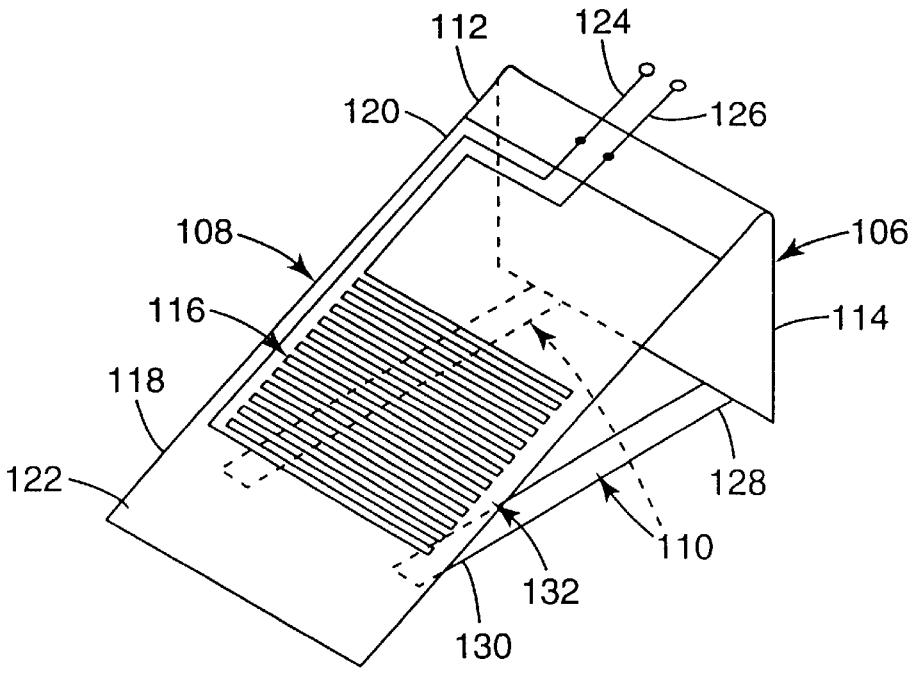
FIG. 10 is a perspective view illustrating a thermal sensor for use with a thermal drum processor in accordance with the present invention.

Referring to FIG. 10, a perspective view of thermal sensor 102 is generally shown. Thermal sensor 102 includes mounting or support member 106, flexible sensor sheet assembly 108, and leaf springs 110. Flexible sensor sheet assembly 108 and leaf springs 110 are each coupled at one end to mounting and support member 106.

Mounting and support member 106 includes a lip portion 112 and a frame portion 114. In one preferred embodiment, mounting and support member 106 is made of stainless steel or other suitable support material.

Flexible sensor sheet assembly 108 includes a wire resistance thermal device 116 which is laminated between flexible sheet material 118 (or alternatively, may be embedded within flexible sheet 118). In one preferred embodiment, flexible sheet material 118 is made of thin sheets (e.g., 0.4 mm) of a higher strength, low friction material, such as high temperature polyimide (i.e., Kapton™) or polytetrafluoroethylene (PTFE). The wire RTD is formed in a pattern, such as the serpentine pattern shown, which allows the wire RTD to sense a large surface area of the cylindrical drum 26. In one preferred embodiment, the RTD pattern provides a temperature sensing area approximately 57 mm×20 mm. The flexible sheet material 118 include a first end 120 and a second end 122. Flexible sheet material 118 is secured to lip portion 112 at first end 120 using a high temperature adhesive. Further, wire RTD 116 is electrically coupled to electrical connectors 124, 126 for providing an output signal from thermal sensor 102 representative of the sensed temperature.

Leaf springs 110 extend between mounting and support member 106 and flexible sensor sheet assembly 108. Leaf springs 110 include first end 128 and second end 130. Leaf springs 110 are mechanically coupled to frame portion 114 at first end 128. In one preferred embodiment, leaf springs 110 are formed as part of (or integral to) frame portion 114. Leaf spring ends 139 bias the flexible sensor sheet assembly 108 against the drum surface. In particular, as the drum 26 rotates, leaf springs 110 bias the flexible sensor sheet assembly 108 against the drum surface 104, and as the flexible sensor sheet assembly 108 drags against the drum surface 104, the shape of the flexible sensor sheet assembly 108 conforms to the shape of the exterior drum surface 104. In one preferred embodiment, leaf springs 110 are made of shim or spring steel, or other similar suitable material.

Figure 11:
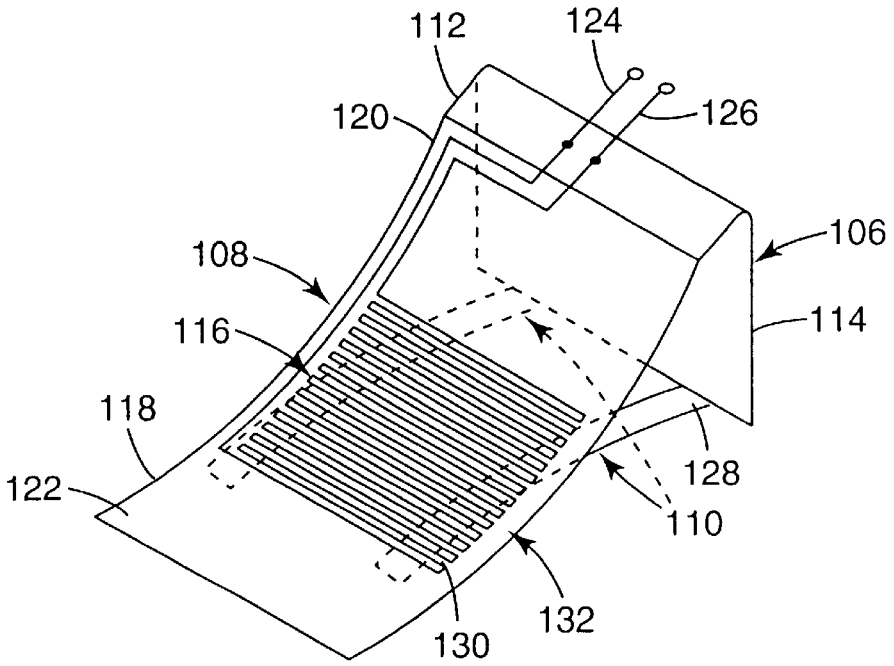
FIG. 11 is a perspective view illustrating the thermal sensor of FIG. 10 in a flexed position.

Referring to FIG. 11, thermal sensor 102 is shown in a flexed position, similar to being positioned against the exterior surface 104 of the cylindrical drum 26. In the flexed position, the large surface area of wire RTD 116 (which conforms to the shape of the drum surface) allows for a uniform temperature reading of the exterior drum surface 104. It is noted that wire RTD 116 does not extend all the way into the pressure application region of flexible sheet material 118 because of the tendency to accumulate fatty acids (a by-product of the thermal development process) in that area, which could affect the accuracy of the temperature measurements. As mounting and support member 106 supports the thermal sensor 102 against the exterior drum surface 104, leaf springs 110 operate to provide the necessary upward spring pressure for holding the temperature sensing area, indicated at 132, of the thermal sensor 102 against the moving exterior drum surface 104. Further, the use of high temperature, electrically insulative, low friction materials for flexible sheet material 118, such as the materials previously described herein, allows the cylindrical drum 26 to continue to rotate during the thermal development process without interference from the thermal sensor 102. The flexing of flexible sheet material 118 allows a considerable or significant area of the laminate to conform to the shape of the cylindrical drum 26 and engage the exterior drum surface 104 for an accurate and true temperature reading without interfering with drum rotation. The pressure from the leaf springs and rotation of the drum results in the sensor tensioning itself about the surface of the drum.

Figure 12:
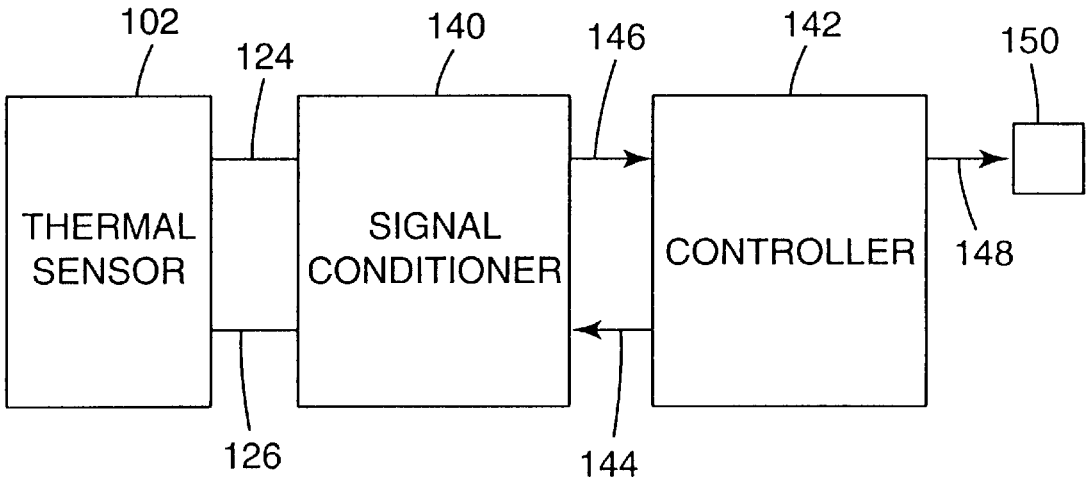
FIG. 12 is a control block diagram of a thermal sensor for use with a thermal processor in accordance with the present invention.

Referring to FIG. 12, a control block diagram for thermal sensor 102 is shown. The diagram includes signal conditioner 140 and controller 142. Connectors 124, 126 are electrically coupled to signal conditioner 140. Further, a power or current input signal 144 can be received by signal conditioner 140 for thermal sensor 102. Signal conditioner 140 may include a resistance measuring device for providing an output signal 146 which is representative of the drum surface temperature. In the exemplary embodiment shown, the output signal 146 is received by controller 142. The controller 142 may be part of the laser imaging system controller, a thermal processor controller, a microprocessor, or computer, sequence of logic gates, or other devices capable of performing logical operations. In response to output signal 146, controller 142 provides an output signal 148 to other devices (indicated at 150) for regulation of drum temperature. In one exemplary embodiment, controller 142 provides output signal 148 to the thermal processor heating mechanism.

Having described the exemplary embodiments of the invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed:

1. In a thermal drum processor having a rotatable drum including an exterior drum surface and an axis of rotation extending longitudinally therethrough, the improvement comprising a roller mounting assembly for removably mounting a plurality of longitudinally extending rollers about the exterior drum surface, wherein the rollers are mounted generally parallel to the axis of rotation of the drum, the roller mounting assembly including a roller retaining member, wherein the roller retaining member includes a plurality of roller attachment mechanisms spaced in a circumferential pattern which define a plurality of roller mounting locations, and wherein the rollers removably fit in a radial fashion into each roller mounting location.

2. The thermal drum processor of claim 1, wherein the roller retaining member is made of a high temperature molded polymeric material.

3. The thermal drum processor of claim 1, wherein the roller retaining member further includes:

a plurality of spring cavities, wherein each spring cavity is located adjacent one of the roller mounting locations; and a spring mechanism located in each spring cavity for applying a radial bias force to a roller mounted in the roller mounting location associated therewith to urge the roller into a film engaging nip between the roller and the exterior drum surface.

4. The thermal drum processor of claim 1, wherein the roller attachment mechanism includes a plurality of snap fingers extending from the roller retaining member, and wherein a pair of adjacent snap fingers define a roller mounting location.

5. The thermal drum processor of claim 1, wherein each roller comprises a longitudinally extending shaft having a sleeve bearing mounted thereon for insertion into a roller mounting location, thereby allowing rotation of each roller relative to the roller retaining member.

6. The thermal drum processor of claim 5, wherein the sleeve bearing is made of a polymeric material.

7. The thermal drum processor of claim 1, wherein the plurality of roller attachment mechanisms are configured to receive the rollers by a snap fit.

8. In a film thermal drum processor having a rotatable drum including an outer surface and an axis of rotation extending therethrough and a plurality of pressure rollers whose axes are aligned parallel to the axis of rotation to the drum and are circumferentially arranged to align the surfaces of the rollers with the outer surface of the drum, a pair of roller retention members for rotatably receiving both ends of the rollers, each of the retention members comprising, in combination:

a frame;

a plurality of roller attachment means disposed along an inner face of the frame in a semi-circular array of roller mounting locations, each of the plurality of roller attachment means being configured to releasably maintain a roller end;

a plurality of spring cavities in said frame, each of which is positioned adjacent a roller mounting location; and a plurality of springs positioned in each of said spring cavities for applying a radial bias force to a roller mounted in the roller mounting location associated therewith and urging the roller into a film engaging nip with the outer surface of said drum.

9. The retention member of claim 8, wherein the attachment means for each roller are a pair of snap fingers adapted for receiving a roller snapped into engagement with the finger thereof in a roller mounting location.

10. The retention member of claim 9, wherein each roller has a plastic sleeve bearing member mounted thereon prior to insertion into the snap fingers of the attachment means.

11. The invention of claim 9, wherein the retention member is molded as a unitary construction from a plastic material.

12. A method of using a thermal drum processor having a rotatable drum including an exterior drum surface and an axis of rotation extending longitudinally therethrough, the method including:

providing a roller mounting assembly including a plurality of roller mounting locations for removably mounting a plurality of longitudinally extending rollers about the exterior drum surface, each of the plurality of rollers being radially fitted into a respective one of the roller mounting locations;

processing a plurality of photothermographic film through the thermal drum processor;

releasing at least one of the plurality of rollers from the roller mounting assembly for cleaning; and removably re-mounting the at least one of the plurality of rollers to the roller mounting assembly.

* * * * *